US008273976B1

(12) United States Patent
Dalby

(10) Patent No.: US 8,273,976 B1
(45) Date of Patent: Sep. 25, 2012

(54) METHOD OF PROVIDING A MUSICAL SCORE AND ASSOCIATED MUSICAL SOUND COMPATIBLE WITH THE MUSICAL SCORE

(76) Inventor: Michael Dalby, New York, NY (US)

( * ) Notice: Subject to any disclaimer, the term of this patent is extended or adjusted under 35 U.S.C. 154(b) by 649 days.

(21) Appl. No.: 12/501,254

(22) Filed: Jul. 10, 2009

Related U.S. Application Data

(60) Provisional application No. 61/199,512, filed on Nov. 16, 2008.

(51) Int. Cl.
*G10H 7/00* (2006.01)

(52) U.S. Cl. ..... 84/602; 84/477 R; 84/483.2; 84/610; 84/615; 84/645

(58) Field of Classification Search ..... None
See application file for complete search history.

(56) References Cited

U.S. PATENT DOCUMENTS

| | | | | |
|---|---|---|---|---|
| 6,751,439 | B2 * | 6/2004 | Tice et al. | 434/350 |
| 7,129,407 | B2 * | 10/2006 | Hiratsuka et al. | 84/609 |
| 2002/0144586 | A1 * | 10/2002 | Connick, Jr. | 84/478 |
| 2002/0162445 | A1 * | 11/2002 | Naples et al. | 84/610 |
| 2003/0094091 | A1 * | 5/2003 | Brinkman et al. | 84/609 |
| 2003/0094092 | A1 * | 5/2003 | Brinkman et al. | 84/609 |
| 2004/0139845 | A1 * | 7/2004 | Tohgi et al. | 84/600 |
| 2005/0016368 | A1 * | 1/2005 | Perla | 84/723 |
| 2006/0288842 | A1 * | 12/2006 | Sitrick et al. | 84/477 R |
| 2007/0227336 | A1 * | 10/2007 | Fukada | 84/600 |
| 2008/0002549 | A1 * | 1/2008 | Copperwhite et al. | 369/83 |
| 2008/0011149 | A1 * | 1/2008 | Eastwood et al. | 84/612 |
| 2008/0271591 | A1 * | 11/2008 | Lemons | 84/601 |
| 2011/0203442 | A1 * | 8/2011 | Raveendran | 84/483.1 |
| 2011/0283867 | A1 * | 11/2011 | Ihara | 84/478 |

OTHER PUBLICATIONS

Musical Instrument Digital Interface (admitted prior art), http://en.wikipedia.org/wiki/MIDI (last visited Oct. 20, 2009), 16 pages.
Finale Music Composing & Notation Software (admitted prior art), http://www.finalemusic.com (last visited Oct. 20, 2009), 1 page.
Finale Family Detailed Product Comparison Chart (Oct. 1, 2008), available at http://downloads2.makemusic.com/forms/ProductComparisons2009.pdf, 5 pages.
Sibelius—the leading music composition and notation software (admitted prior art), http://www.sibelius.com/home/index_flash.html (last visited Oct. 20, 2009), 1 page.

* cited by examiner

*Primary Examiner* — Marlo Fletcher
(74) *Attorney, Agent, or Firm* — Barnes & Thornburg

(57) ABSTRACT

A synchronized performance process includes performing a first portion of a musical work using musicians and performing a second portion of the musical work using a computer.

20 Claims, 3 Drawing Sheets

METHOD OF PROVIDING A MUSICAL SCORE AND ASSOCIATED MUSICAL SOUND COMPATIBLE WITH THE MUSICAL SCORE

This application claims priority under 35 U.S.C. §119(e) to U.S. Provisional Application No. 61/199,512 filed Nov. 16, 2008, which is expressly incorporated by reference herein.

BACKGROUND

The present disclosure relates to musical scores for a live performance, and in particular, to a method for generating musical scores for use in the live performance. More particularly, the present disclosure relates to a method of printing musical scores for use by musicians performing in the live performance.

SUMMARY

A process for performing a musical work, in accordance with the present disclosure, comprises the steps of selecting instrumental scores and printing musical scores associated with the selected instrumental scores. Musicians use the printed musical scores to play instruments associated with instrumental scores during a live performance.

In illustrative embodiments, the process includes a step of obtaining a computer file comprising a series of musical tracks representing instrumental scores and selecting a first set of music tracks to be played by a computer controlling a music synthesizer and a second set of music tracks to be played by the musicians. In illustrative embodiments, the second set of music tracks establishes a sheet-music printing package. The sheet-music printing package is subsequently converted into musical scores for printing and use by the musicians.

In illustrative embodiments, the process further includes a step of selecting a third set of music tracks to establish a musical-practice package. The musical-practice package is used by the musicians to practice for the live performance. The musical-practice package includes collections of music tracks which are played by a computer controlling a music synthesizer during a practice session so that each musician may practice without any other musicians.

In illustrative embodiments, the process further includes a step of altering musical characteristics associated with each music track of the musical work. The altering step is executed prior to converting the music tracks into musical scores for play by musicians or computer files for play by a computer controlling a music synthesizer. In illustrative embodiments, a musical key characteristic may be adjusted to suit the available instruments or the singing ability of a performer.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
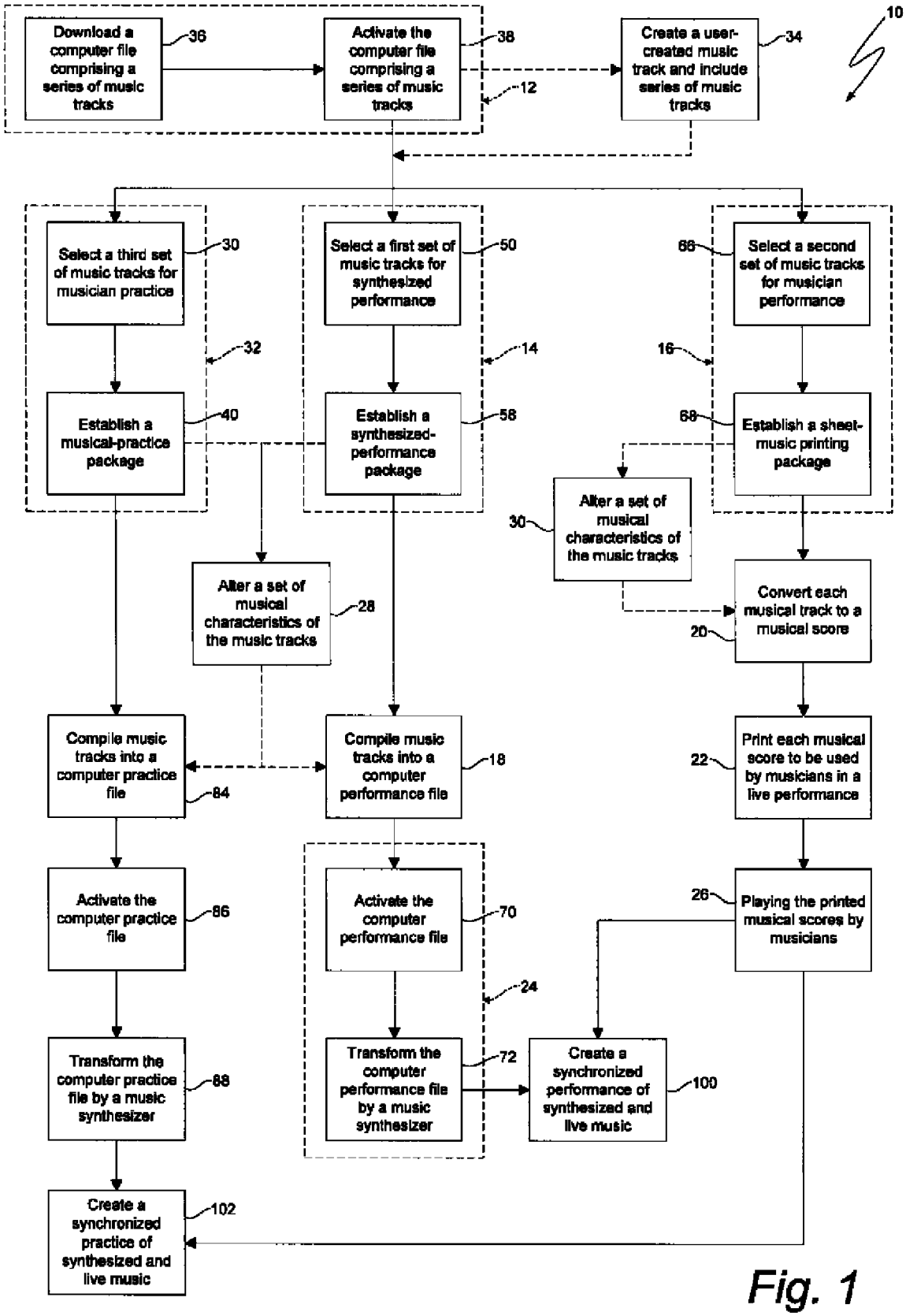
FIG. 1 is a diagrammatic view of a method in accordance with the present disclosure for providing printed musical scores for use by musicians in performing or practicing a musical work and for providing musical tracks for play by a computer controlling a music synthesizer simultaneously with the musicians during a live performance or a practice session.

A synchronized performance process 10 is used for creating printed scores of music for use by human musicians during practice and performance as illustrated in FIG. 1. Synchronized performance process 10 also is used for creating an audio output of additional music tracks selected to supplement the performance of the musicians. Synchronized performance process 10 further allows a performance group, illustratively an orchestra, theatre group, or any other group performing a musical work, to perform the musical work without having all the musicians necessary to play all the instruments in the musical work.

As an example, a musical work is created that uses a flute, a violin, a trombone, a cello, a guitar, and a piano during the performance. The performance group only has a musician able to play the guitar and a musician able to play the piano. Thus, the performance group uses synchronized performance process 10 to synthesize the music tracks associated with the flute, violin, trombone, and cello so that the musical work may be performed with only the available musicians.

Figure 2:
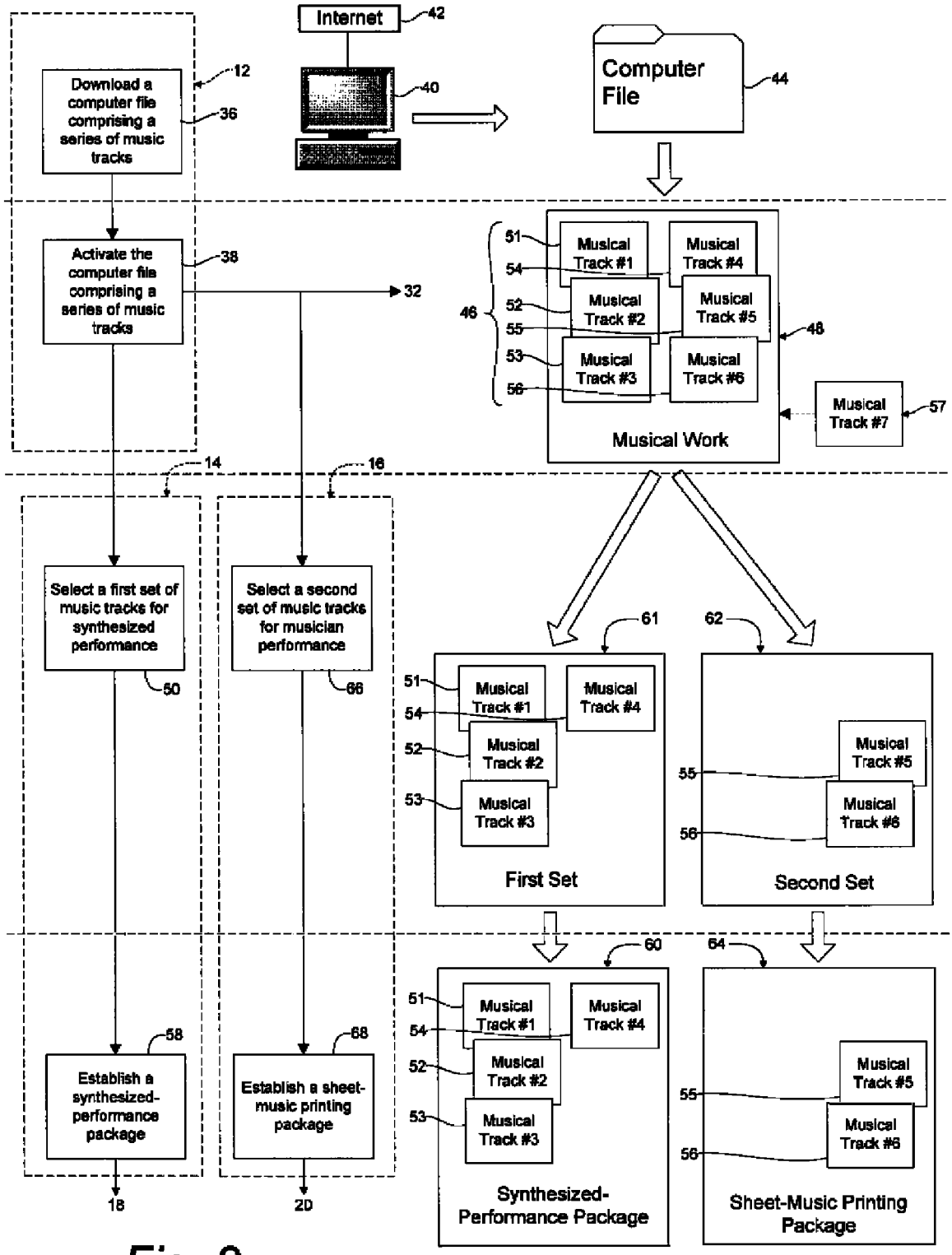
FIG. 2 is a diagrammatic view of a portion of the method of FIG. 1 showing that a computer file associated with the musical work includes multiple music tracks and that subsequent steps select a first set of tracks to establish a synthesized-performance package for play by a computer controlling a music synthesizer and a second set of tracks to establish a sheet-music printing package for play by musicians.
Figure 3:
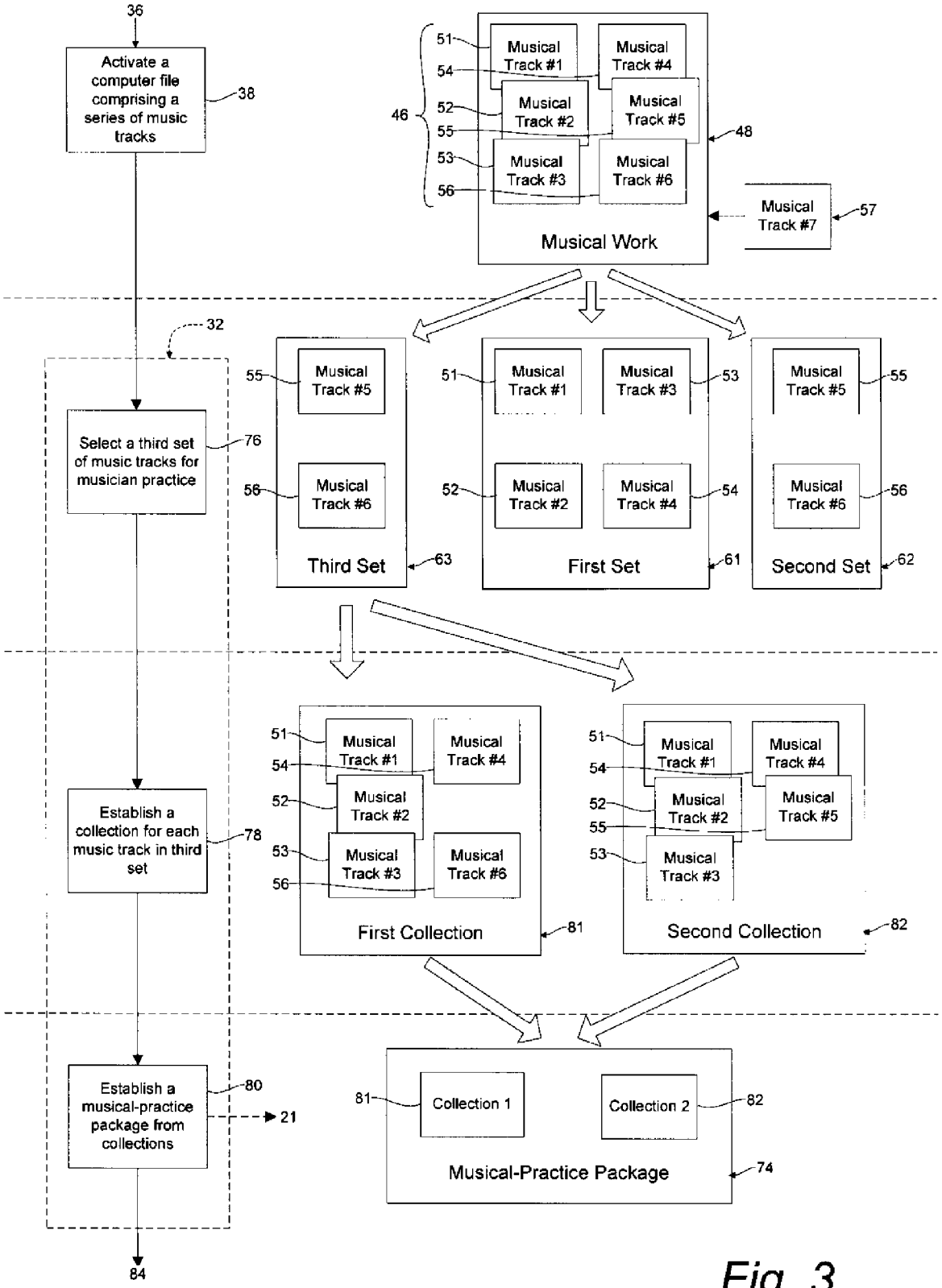
FIG. 3 is a diagrammatic view of a portion of the method of FIG. 1 showing that a third set of tracks may be selected to establish a musical-practice package that comprises music tracks played by a computer controlling a music synthesizer that permits each musician to practice the musical work without any other musicians.

Illustratively, synchronized performance process 10 includes a first step 12 of obtaining a licensed computer file 44 comprising a series 46 of music tracks associated with the various instruments required to perform a musical work 48 as suggested in FIGS. 1-3. A second step 14 includes selecting a first set 61 of music tracks to establish a synthesized-performance package 60 that is played by a computer controlling a music synthesizer. A third step 16 includes selecting a second set 62 of music tracks to establish a sheet-music printing package 64 that is used by musicians to play the corresponding instruments. A fourth step 18 includes converting first set 61 of music tracks included in synthesized-performance package 60 into a computer performance file. A fifth step 20 includes converting each of the music tracks in second set 62 of sheet-music printing package 64 into musical scores. A sixth step 22 includes printing each of the musical scores of sheet-music printing package 64. A seventh step 24 includes playing the computer performance file on a computer controlling a music synthesizer during a synchronized musical performance 100. An eighth step 26 includes musicians playing the printed musical scores during synchronized musical performance 100 simultaneously with the computer controlling a music synthesizer playing the performance file.

As suggested in FIG. 1, synchronized performance process 10 also includes a musical-characteristic alteration step 28 associated with synthesized-performance package 60 and a musical-characteristic alteration step 30 associated with sheet-music printing package 64. Musical-characteristic alteration steps 28, 30 allow the performance group to alter various attributes of the music tracks included in musical work 48 to better facilitate the instruments and singers available. An illustrative set of musical characteristics which may be altered include, but are not limited to, the musical key, the tempo, and the dynamics of each music track.

Musical-characteristic alteration step 28, associated with the synthesized-performance package 60, is executed after synthesized-performance package 60 is established, but prior to compiling the music tracks included in synthesized-performance package 60 into a computer performance file. Musical-characteristic alteration step 30, associated with sheet-music printing package 64, is executed after sheet-music printing package 64 is established, but prior to converting each music track into a musical score.

As illustrated in FIGS. 1 and 3, synchronized performance process 10 also includes a practice-selection step 32 of selecting a third set 63 of music tracks to establish a musical-practice package 74. Step 32 is executed after the computer file containing musical work 48 is executed, and simultaneously with selecting first and second sets 61, 62 of music tracks. Illustratively, third set 63 of music tracks are those with which the musicians would like to practice. Thus, musical-practice package 74 allows a musician to practice their printed musical score while a computer controlling a music synthesizer plays the other music tracks of musical work 48 that may be helpful to each practicing musician.

Synchronized performance process 10 further includes a music-track creation step 34 shown in FIG. 1. Music-track creation step 34 provides the performance group with the ability to create one or more tracks and then add them to the series of tracks comprising musical work 48. Illustratively, the performance group may create a seventh music track 57 associated with a new instrument or arrangement for inclusion in musical work 48 as shown in FIGS. 2 and 3. Music-track creation step 34 is executed after licensed computer file 44 is activated in first step 12 so that the user-created music track may be included with series 46 of tracks and included in one of first, second, or third sets 61, 62, and 63 of music tracks. Music-track creation step 34 permits the performance group to maximize their creativity and flexibility in performing musical work 48.

As shown in FIGS. 1 and 2, first step 12 includes a downloading action 36 and an activation action 38. Illustratively, the performance group performs downloading action 36 by operating a computer 40 connected to Internet 42 to download a licensed computer file 44. Licensed computer file 44 contains a series 46 of music tracks that together comprises a musical work 48 as suggested in FIG. 2.

Activation action 38 allows licensed computer file 44 to be accessed so that series 46 of music tracks are selected and arranged to establish a first set 61 of music tracks, a second set 62 of music tracks, and a third set 63 of music tracks as suggested in FIGS. 2 and 3. As an example, licensed computer file 44 includes a first, second, third, fourth, fifth, and sixth music tracks 51, 52, 53, 54, 55, and 56.

As shown in FIGS. 1 and 2, second step 14 includes a selection action 50 and an establishment action 58. As an example, only two musicians are available to perform musical work 48. Thus, during selection action 50, first set 61 of music tracks are selected to be included in synthesized-performance package 60. Illustratively, first set 61 of music tracks includes first, second, third, and fourth music tracks 51, 52, 53, and 54. During establishment action 58, music tracks 51, 52, 53, 54 of first set 61 are grouped together to establish synthesized-performance package 60. During performance of musical work 48, synthesized-performance package 60 is played by a computer controlling a music synthesizer.

Third step 16 of synchronized performance process 10 includes a selection action 66 and an establishment action 68. During selection action 66, a second set 62 of music tracks are selected that includes fifth and sixth music tracks 55, 56. During establishment action 68 of third step 16, fifth and sixth music tracks 55, 56 are grouped together to establish a sheet-music printing package 64. During performance of musical work 48, printed music scores associated with sheet-music printing package 64 are played by musicians.

As suggested in FIG. 1, fourth step 18 includes compiling first set 61 of music tracks in synthesized-performance package 60 into a musical performance file. Illustratively, a computer reads first set 61 of music tracks and writes the information contained in first set 61 into a computer performance file to be played by a computer controlling a music synthesizer during the performance of musical work 48. As an example, the performance file is a MIDI file, but any other suitable file type may be used.

Fifth step 20 includes converting each music track included in sheet-music printing package 64 into musical scores as suggested in FIG. 1. Each musical score provides information so that musicians reading the musical score can play the corresponding instrument. As an example, fifth and sixth music tracks 55, 56 are converted into first and second music scores. Sixth step 22 includes printing each of the musical scores formed in fifth step 20. Printing only those scores included in second set 62 minimizes the use of excess paper as only those scores played by musicians are printed.

Seventh step 24 includes playing the computer performance file compiled in fourth step 18 during synchronized musical performance 100 of musical work 48. Illustratively, seventh step 24 includes an activation action 70 and a transformation action 72. Activation action 70 is executed by opening the computer performance file on a computer capable of controlling a music synthesizer. Transformation action 72 is executed by the computer controlling the music synthesizer to read the computer performance file and convert the music performance file into audio heard through loud speakers.

Eighth step 26 of synchronized performance process 10 includes playing the printed musical scores by musicians during synchronized musical performance 100. Simultaneously, the computer controls the music synthesizer to play the computer performance file over loud speakers to cause synchronized musical performance 100 of musical work 48 to be created so that the audience hears the complete instrumentation of the musical work. As an example, the audience hearing a synchronized performance of musical work 48 would hear six parts being played. Two parts are played by musicians using the printed musical scores and four parts are played by the computer controlling a music synthesizer using the computer performance file.

Synchronized performance process 10 also includes a practice-selection step 32 of selecting third set 63 of music tracks to establish musical-practice package 74. As shown in FIG. 3, practice-selection step 32 is executed after licensed computer file 44 containing musical work 48 is activated, and simultaneously with selecting first and second sets 61, 62 of music tracks. Illustratively, third set 63 of music tracks are those which the musicians would like to practice or be accompanied by. Thus, musical-practice package 74 allows a musician to practice their printed musical score while a computer controlling a music synthesizer plays the other music tracks of musical work 48 that are helpful to each practicing musician.

As shown in FIG. 3, step 32 illustratively includes a first action 76 of selecting third set 63 of music tracks from musical work 48. As an example, third set 63 includes fifth and sixth music tracks 55, 56 as a result of second set 62 including fifth and sixth music tracks 55, 56 so that each musician will have their own computer practice file.

Step 32 also includes a second action 78 of establishing a first and second collection 81, 82 for each music track in third set 63 as suggested in FIG. 3. As an example, first collection 81 includes first, second, third, fourth, and sixth music tracks 51, 52, 53, 54, and 56 so that when first collection 81 is compiled into a computer practice file, the musician associated with fifth music track 55 is able to practice with all the other music tracks of musical work 48 being played. Second collection 82 includes first, second, third, fourth, and fifth music tracks 51, 52, 53, 54, and 55 so that when second collection 82 is compiled into a computer practice file, the musician associated with sixth music track 56 is able to practice with all the other music tracks of musical work 48.

Finally, step 32 includes a third action 80 of establishing musical-practice package 74 that illustratively includes first and second collections 81, 82 as shown in FIG. 3. After step 32 is complete, musical-practice package 74 is then put through a subsequent step 84 of compiling each collection 81, 82 into companion computer practice files as suggested in FIG. 1. After subsequent step 84, the computer practice files are ready for use by musicians during practice of musical work 48.

Synchronized practice 102 is achieved in a series of steps that include an initial step 86 of activating the computer practice file as suggested in FIG. 1. In a next step 88, the computer practice file is transformed by a computer controlling a music synthesizer so that audio is produced and the musician is able to practice with the produced audio. The practice step provides each musician with the ability to practice musical work 48 without the need to practice with other musicians thus providing flexibility to practice when time is available for an individual musician.

The music tracks included in third set 63 of musical-practice package 74 may have their musical characteristics altered in a manner similar to the music tracks of first set 61 of synthesized-performance package 60. As suggested in FIG. 1, musical-practice package 74 may have its musical characteristics altered in musical-characteristic alteration step 28. By executing musical-characteristic alteration step 28 on musical-practice package 74, musicians are provided practice audio having the same characteristics as those of the music scores in sheet-music printing package 64 and synthesized-performance package 60.

As suggested in FIG. 2, the performance group obtains licensed computer file 44 by using computer 40 connected to Internet 42. Licensed computer file 44 is provided by a copyright holder or a licensing entity of musical work 48. Alternatively, licensed computer file 44 may be provided on a Compact Disc (CD) by the licensing entity. In use, licensed computer file 44 may be provided by any suitable method by the licensing entity. Licensed computer file 44 file removes the need for the licensing entity to print the sheet music and scores for musical work 48 and minimizes the cost of printing and shipping the sheet music and scores provided to the performance group.

Illustratively, the licensed computer file may be encoded by the licensing entity to cause the computer file to function only for certain dates or an amount of time. The encoding allows the licensing entity to control the license duration of the computer file and minimizes the need for the performance group to gather any printed scores and sheet music to ship back to the licensing entity. As a result, the cost of licensing the musical work 48 is minimized, as are the costs of printing and shipping associated with managing the license of musical work 48.

Illustratively, licensed computer file 44 is a Musical Instrument Digital Interface (MIDI) file type, but any other suitable alternative computer file type may be used. Similarly, the computer performance file created by fourth step 18 and the computer practice file created by subsequent step 84 is also of the MIDI file type, but any other suitable alternative may be used. Alternatively, computer practice file 84 may be transformed by a computer controlling a music synthesizer into audio and recorded as a Wave type file (.wav) or MP3 type file (.mp3) to maximize convenience for musicians who may not have access to a computer and a music synthesizer while practicing.

The invention claimed is:

1. A process comprising the steps of activating a MIDI file comprising a series of music tracks, each music track representing an instrumental score for a specified musical instrument, selecting some of the music tracks in the series of music tracks to establish a synthesized-performance package, selecting others of the music tracks in the series of music tracks to establish a sheet-music printing package, converting each of the music tracks in the sheet-music printing package to a musical score, printing the musical scores associated with each of the music tracks in the sheet-music printing package to provide printed musical scores for use by human musicians playing instruments in a live musical performance, converting the music tracks in the synthesized-performance package into a computer performance file comprising sounds of various instruments performing music associated with the music tracks in the synthesized-performance package, and activating the computer performance file to create sounds of the various instruments performing music associated with the music tracks in the synthesized-performance package during the live musical performance while human musicians are using the printed musical scores to create sounds associated with the music tracks in the sheet-music printing package.

2. The process of claim 1, further comprising the steps of converting the music tracks in the sheet-music printing package to a selected musical key before the printing step and subsequently converting the music tracks in the synthesized-performance package to the selected musical key before the step of converting the music tracks in the musical-performance package into the computer performance file.

3. The process of claim 2, further comprising the steps of selecting some of the music tracks in the series of music tracks to establish a musical-practice package and converting the music tracks in the musical-practice package into a computer practice file comprising sounds of various instruments performing music associated with the music tracks in the musical-practice package.

4. The process of claim 3, further comprising the step of activating the computer practice file to create the sounds of the various instruments performing music associated with the music tracks in the musical-practice package during a live practice session while human musicians are using the printed musical scores to create sounds associated with the music tracks in the sheet-music printing package.

5. The process of claim 3, further comprising the step of converting the music tracks in the musical-practice package into the selected musical key before the step of converting the music tracks in the synthesized-performance package.

6. The process of claim 1, further comprising the step of downloading the licensed computer file from a computer operably coupled to an Internet server before the step of activating the computer file.

7. The process of claim 1, further comprising the steps of altering a set of musical characteristics included in the music tracks of the sheet-music printing package before the printing step and altering the set of musical characteristics included in the music tracks in the synthesized-performance package before the step of converting the music tracks in the synthesized-performance package into the computer performance file.

8. The process of claim 7, wherein the set of musical characteristics include a musical key characteristic, a tempo characteristic, and a musical dynamics characteristic.

9. The process of claim 1, further comprising the steps of creating a user-created music track before the selecting steps and including the user-created music track in one of the synthesized-performance package and the sheet-music printing package prior to the converting steps.

10. A process comprising the steps of activating a computer file comprising a series of music tracks, each music track representing an instrumental score for a specific musical instrument, selecting some of the music tracks in the series of music tracks to establish a musical-practice package, selecting others of the music tracks in the series of music tracks to establish a sheet-music printing package, converting each of the music tracks in the sheet-music printing package to a musical score, printing the musical scores associated with each of the music tracks in the sheet-music printing package to provide printed musical scores for use by musicians playing instruments in a live practice session, converting the music tracks in the musical-practice package into a computer practice file comprising sounds of various instruments performing music associated with the music tracks in the musical-practice package, and activating the computer practice file to create sounds of the various instruments performing music associated with the music tracks in the musical-practice package during the live practice session while musicians are using the printed musical scores to create sounds associated with the music tracks in the sheet-music printing package.

11. The process of claim 10, further comprising the steps of converting the music tracks in the sheet-music printing package to a selected musical key before the printing step and converting the music tracks in the musical-practice package to the selected musical key before the step of converting the music tracks in the musical-practice package into the computer practice file.

12. A process comprising the steps of obtaining a licensed computer file comprising a series of music tracks, each music track representing an instrumental score for a specified musical instrument, selecting a first set of music tracks included in the series of music tracks to establish a synthesized-performance package, selecting a second set of music tracks included in the series of music tracks to establish a sheet-music printing package, compiling the first set of music tracks in the synthesized-performance package into a computer performance file played using a computer controlling a music synthesizer during a synchronized performance, converting each of the music tracks in the sheet-music printing package to a musical score played by a musician using the specified musical instrument during the synchronized performance, and activating the computer performance file to create sounds of the various instruments performing music associated with the music tracks in the synthesized-performance package during a live musical performance while human musicians are using the printed musical scores to create sounds associated with the music tracks in the sheet-music printing package.

13. The process of claim 12, further comprising the step of selecting a third set of music tracks included in the series of music tracks to establish a musical-practice package after the step of obtaining the licensed computer file.

14. The process of claim 13, wherein the step of selecting the third set of music tracks includes the step of establishing collections associated with each track included in the third set of music tracks, each collection includes at least one of the music tracks included in the first set of music tracks, and the collections establish the musical-practice package.

15. The process of claim 14, further comprising the step of converting the music tracks in each collection of the musical-practice package to establish a computer practice file associated with each collection after the step of establishing the collections included in the musical-practice package.

16. The process of claim 15, further comprising the step of activating the computer practice file to create sounds of the various instruments performing music associated with the music tracks of the musical-practice package during the live practice session while the musician practices the musical instrument associated with the sheet-music printing package.

17. The process of claim 16, further comprising the steps of altering a set of musical characteristics included in the music tracks of the sheet-music printing package before the converting step, altering the set of musical characteristics included in the music tracks in the synthesized-performance package before the step of compiling the music tracks in the synthesized-performance package into the computer performance file, and altering the set of musical characteristics included in the music tracks in the musical-practice package before the step of converting the music tracks in each collection into computer practice files.

18. The process of claim 12, wherein the step of obtaining the licensed computer file includes the steps of downloading the licensed computer file comprising the series of music tracks using a computer operably coupled to an Internet website and activating the licensed computer file comprising the series of music tracks using a computer to separate the music tracks.

19. The process of claim 12, further comprising the step of playing the computer performance file using a computer controlling a music synthesizer to create sounds of various instruments performing music associated with music tracks in the synthesized-performance package while musicians are using the printed musical scores to create sounds associated with the music tracks in the sheet-music printing package.

20. The process of claim 19, wherein the licensed computer file and the computer performance file are each MIDI files.

* * * * *